US012643638B2

(12) United States Patent
Ratzlaff

(10) Patent No.: US 12,643,638 B2
(45) Date of Patent: Jun. 2, 2026

(54) MOUNT ADAPTER

(71) Applicant: Henry L. Ratzlaff, Columbia Falls, MT (US)

(72) Inventor: Henry L. Ratzlaff, Columbia Falls, MT (US)

( * ) Notice: Subject to any disclaimer, the term of this patent is extended or adjusted under 35 U.S.C. 154(b) by 512 days.

(21) Appl. No.: 18/143,322

(22) Filed: May 4, 2023

(65) Prior Publication Data

US 2023/0356807 A1 Nov. 9, 2023

Related U.S. Application Data

(60) Provisional application No. 63/338,436, filed on May 4, 2022.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS 382,935 A * 5/1888 Luke ..... B63C 9/30 441/126
3,188,136 A * 6/1965 Redfield ..... A61G 15/02 248/404
4,207,879 A * 6/1980 Safadago ..... A61G 7/10 482/145
4,278,289 A * 7/1981 Esposito ..... B63B 29/06 297/188.12
4,428,617 A * 1/1984 Lawson ..... A01K 97/10 297/188.2
4,766,838 A * 8/1988 Johnson ..... B63B 29/04 114/364
4,879,963 A * 11/1989 Dionne ..... B63B 29/04 297/188.21
4,936,243 A * 6/1990 Shields ..... B63H 25/38 114/127
4,979,458 A * 12/1990 Bouza ..... B63B 43/085 D12/318
5,101,753 A * 4/1992 Hull ..... B63B 7/085 114/345
6,691,970 B1 * 2/2004 Sutton, Sr. ..... B60N 2/14 248/425
6,739,280 B2 * 5/2004 Keller ..... B63B 29/06 114/364

(Continued)

*Primary Examiner* — S. Joseph Morano
*Assistant Examiner* — Jovon E Hayes
(74) *Attorney, Agent, or Firm* — Law Office of Craig Bohn; Craig E. Bohn

(57) ABSTRACT

A mount adapter, comprising a base securable to a gunwale or a frame on a gunwale that may support the mounting of a combination of boating and fishing items, which may include a seat, footrest, armrest, anchor line feed, motor mount, and other various boating and fishing accessories. The mount adapter may offer a swivel intermediate the base and a seat to facilitate the seat having both an orientation to face inwardly to the boat and outwardly from the boat. The mount adapter may offer a footrest and an anchor guide that may extend outwardly from the boat.

20 Claims, 6 Drawing Sheets

(56) References Cited

U.S. PATENT DOCUMENTS

| | | | | |
|---|---|---|---|---|
| 8,651,569 | B2 * | 2/2014 | Andoloro | A47C 1/0303<br>297/423.37 |
| 8,800,467 | B2 | 8/2014 | Temple | |
| 11,707,136 | B2 * | 7/2023 | Richardson | A47C 9/002<br>297/411.36 |
| 2004/0254020 | A1 * | 12/2004 | Dragusin | A47C 15/004<br>463/46 |
| 2008/0048472 | A1 * | 2/2008 | Kuenzel | B60N 2/02246<br>108/20 |
| 2019/0083336 | A1 * | 3/2019 | Norris, Jr. | A61G 5/1091 |

* cited by examiner (PRIOR ART)

MOUNT ADAPTER

CROSS-REFERENCE TO RELATED APPLICATIONS

This application claims the benefit of U.S. Provisional Application No. 63/338,436, filed on May 4, 2022, by the present inventor, entitled "Gunwale Mount Adapter," which both are hereby incorporated by reference in their entirety for all allowable purposes, including the incorporation and preservation of any and all rights to patentable subject matter of the inventor, such as features, elements, processes and process steps, and improvements that may supplement or relate to the subject matter described herein.

STATEMENT REGARDING FEDERALLY SPONSORED RESEARCH OR DEVELOPMENT

Not Applicable

BACKGROUND OF THE INVENTION

This invention relates generally to boats and boat accessories, and more specifically to structures for mounting a selectable combination of seats, footrests, anchors, and other boating and fishing accessories to boats.

Current boat technology teaches various manners of adapting seats to boats. U.S. Pat. No. 5,101,753, issued on Apr. 1, 1992 to Harold Hull and James Morris ("Hull et al.") provided for an attachable, swivel seat for an inflatable boat that sets firmly and freely on a main frame of the motor mount, the seat having adjustable cross members to fit its own motor mount. Frames on inflatable boat or raft platforms, as in Hull et al., are widely used, and can be similar to the one taught in U.S. Pat. No. 8,800,467, issued to James Temple on Aug. 12, 2014. Other ways to structure and mount seats on boats are taught in U.S. Pat. No. 4,766,838, issued to Grady Johnson on Aug. 30, 1988, U.S. Pat. No. 4,936,243, issued to Terry Shields on Jun. 26, 1990, U.S. Pat. No. 4,979,458, issued to William Bouza Dec. 25, 1990, and U.S. Pat. No. 6,739,280, issued to Rogenald Keller on May 25, 2004.

Other patents teach a variety of seats with footrests, such as U.S. Pat. No. 4,879,963, issued to Roland Dionne on Nov. 14, 1989, and U.S. Pat. No. 4,278,289, issued to John Esposito on Jul. 14, 1981. And, U.S. Pat. No. 4,428,617, issued to Jack Lawson on Jan. 31, 1984, teaches pedestal boat seat that supports a fishing accessory-arm rest support assembly to conveniently detachably receive fishing tackle and equipment holding containers to facilitate ease of access thereto.

It would be an improvement to the field of art to have a gunwale adapter that supports the mounting of a combination of boating and fishing items, which may include a seat, footrest, armrest, anchor line feed, motor mount, and other various boating and fishing accessories. It would also be an improvement to the field of art to provide a seat that can mount to a gunwale of a boat, permitting the seat to pivot from a position facing inward to the boat to a position facing outwardly to the boat. It would also be an improvement to the field of art to provide a footrest mounted to a gunwale of a boat so as to extend outwardly from the boat, over the water, such that a person seated in a seat facing outwardly to the boat could rest their feet on the footrest.

DESCRIPTION OF THE PREFERRED EMBODIMENT

Figure 1:
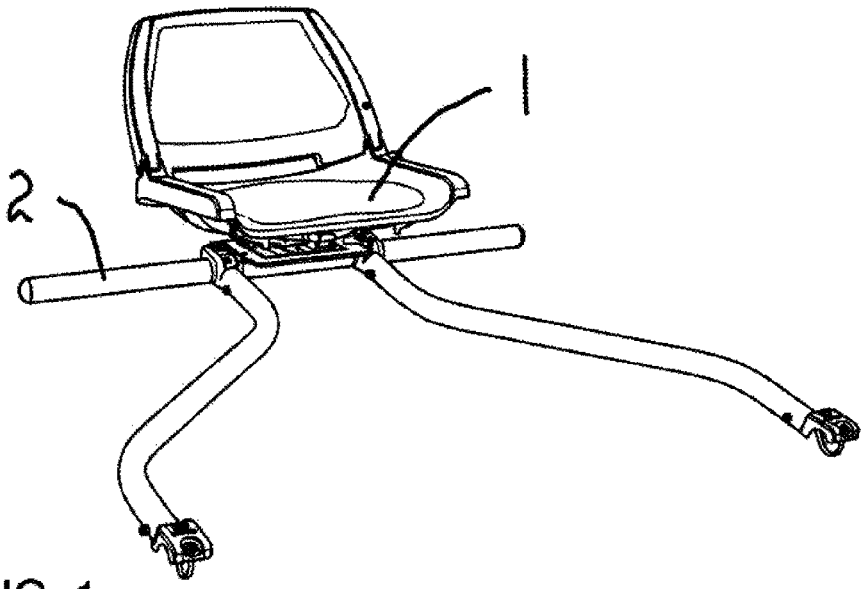
FIG. 1 is a perspective view of an exemplary prior art fishing frame rear section with an attached seat.

Referring now primarily to FIG. 1, an exemplary prior art boat seat 1 is shown attached to a frame 2. Exemplary frame 2 is an example of a rear frame section that may be part of a typical fishing frame used to provide rigidity and anchor points to a boat, especially inflatable boats. It is known in the art that the frames may be attached to the gunwales, and may run various lengths of a boat, and may span from side to side of a boat. The exemplary frame 2 is intended to place seat 1 on top of the gunwale, and offer an individual seated in seat 1 ease of clearance to the water and good visibility.

Figure 2:
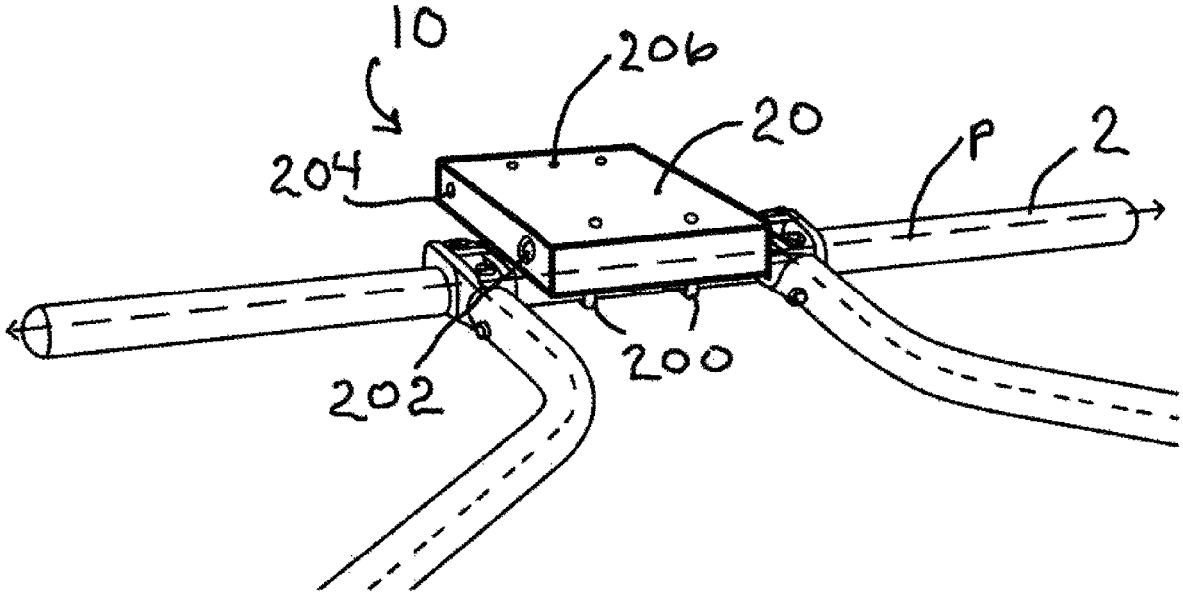
FIG. 2 is a perspective view of an exemplary mount adapter, mounted to a fishing frame rear section, according to the present invention.

Referring now primarily to FIGS. 1 and 2, an exemplary embodiment of a gunwale mount adapter 10 attached to the exemplary frame 2, so as to be positionable on top of a boat gunwale. The exemplary mount adapter 10 is shown comprising a base plate 20. In the exemplary embodiment, base plate 20 is rigidly securable to frame 2 by a pair of mount brackets 200.

Additionally, exemplary mount adapter 10, as shown, may have at least one accessory receive 202, a pin receiver 204, and a detent 206. The accessory receiver 202 may be configured to receive and secure various accessories, as will be discussed later. The other side of a base 20 may also have an accessory receiver 202, to permit the mounting of an accessory on each side. Additional accessory receivers 202 may be provided as desired in a particular embodiment.

Figure 3:
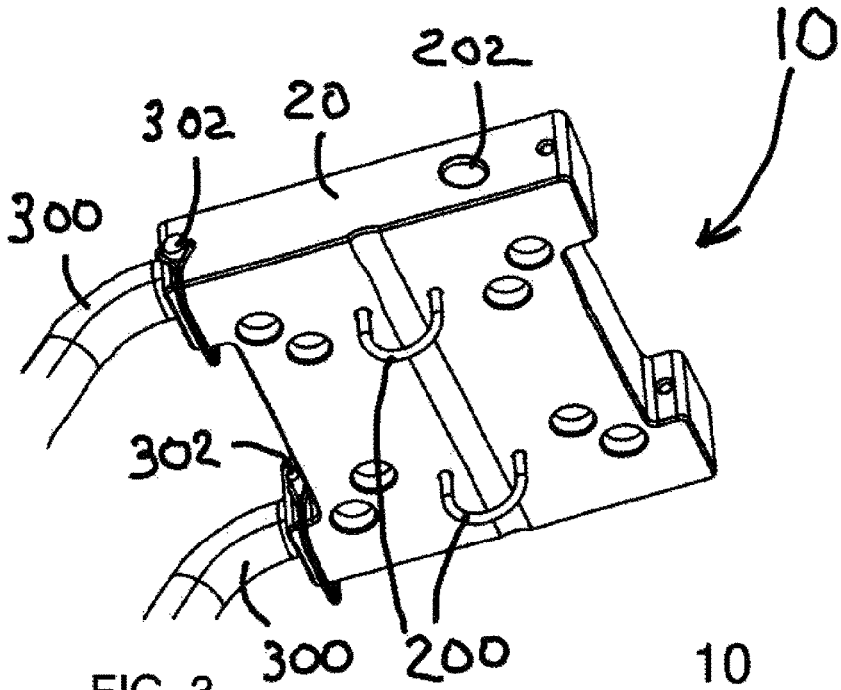
FIG. 3 is a perspective bottom view of an alternate exemplary mount adapter according to the present invention.
Figure 4:
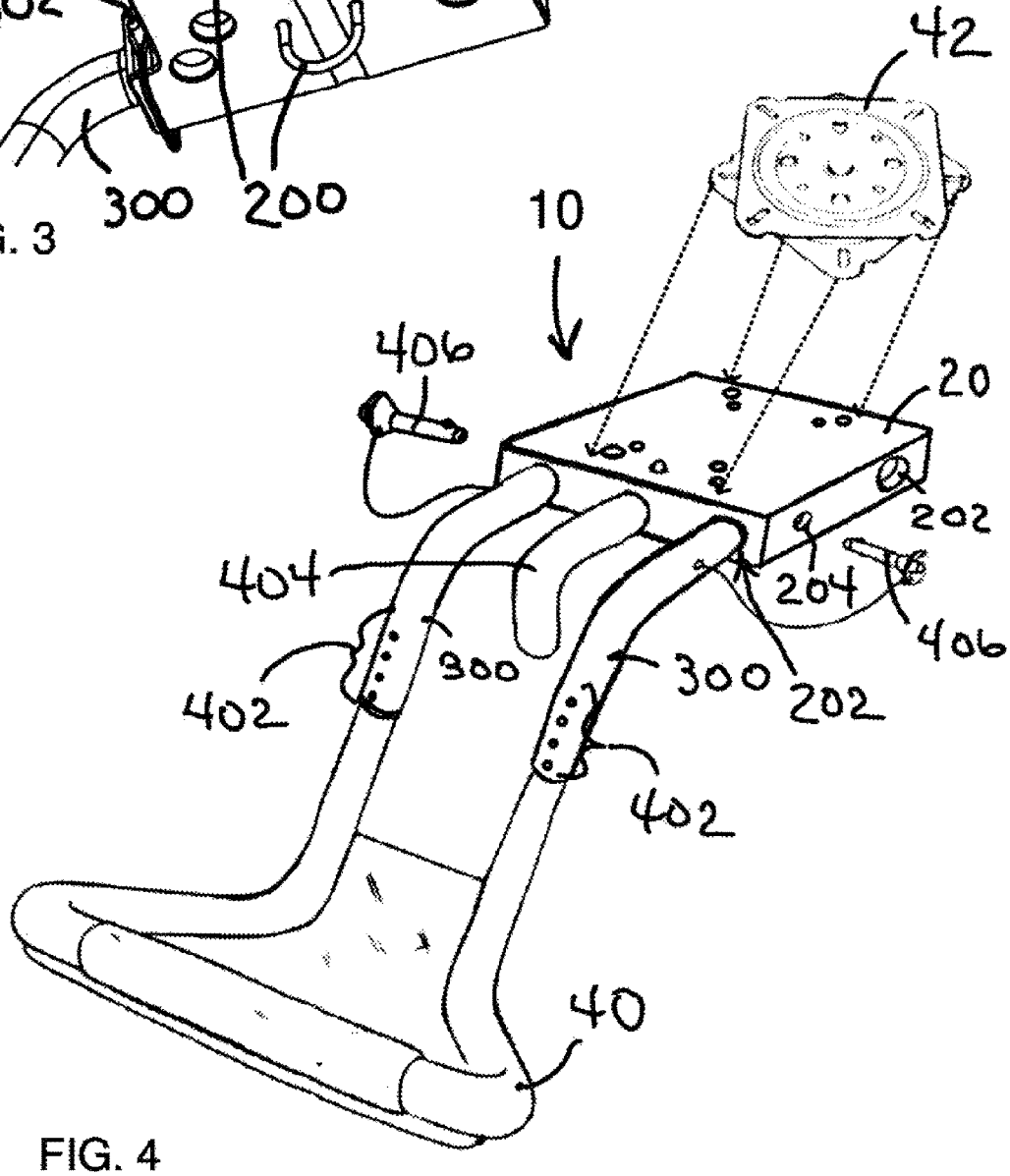
FIG. 4 is a partially exploded perspective top view of an exemplary mount adapter, with a chair swivel and footrest, according to the present invention.

Referring now primarily to FIGS. 2 through 4, an exemplary footrest 40 may be removably secured to base 20 by inserting at least one footrest leg 300 into the base 20, and securing the footrest leg 300 to the base 20 with an exemplary leg pin 302. Various forms of securement and leg pin 302 may be suitable. FIG. 4 shows an alternate exemplary embodiment leg pin 406 securing an exemplary footrest leg 300. Exemplary leg pin 406 is secured by a push-button action, which permits it to be removably inserted in pin receiver 204. Also shown is an exemplary embodiment of an anchor guide 404, inserted into base 20 adjacent to the footrest leg 300, and removably secured in base 20 with detent 206.

In the exemplary embodiment, footrest 40 may be attached to base 20 by footrest legs 300 that may have a leg adjustment 402. In the exemplary embodiment, leg adjustment 402 is shown to have a detent feature that may be secured at various hole positions, but this is only an example, and other manners of providing extensions to the footrest legs 300 may be used within the scope of this invention.

In the exemplary embodiment, an exemplary swivel 42 may be attached to the base 20 on the side opposite the frame 2 attachment. Herein, the side opposite the attachment to the frame may be referred to as the top. In the exemplary embodiment, the swivel 42 may be mounted intermediate the base 20 and a seat 1, so as to permit a person sitting in the seat to rotate between a position facing inwardly to the boat and a position facing outwardly to the boat.

Figure 5:
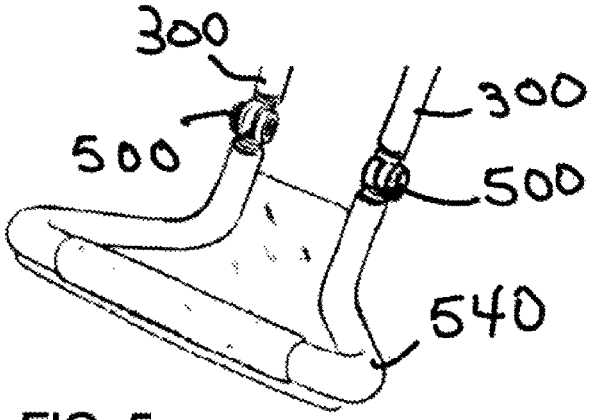
FIG. 5 is a perspective top view of an alternate exemplary footrest useable with a mount adapter according to the present invention.

Referring now primarily to FIG. 5, an alternate exemplary embodiment footrest 540 is shown where each of a pair of footrest legs 300 may have a pair of individual hinges 500, permitting the exemplary footrest 540 to have a deployed position, where the footrest 540 is extended away from a base 20, and a stowed position, where the footrest 540 is folded toward the base 20. The individual hinges 500 may have each have a locking mechanism, capable of holding the footrest 540 in either the deployed or the stowed position, or various positions in between.

Figure 6:
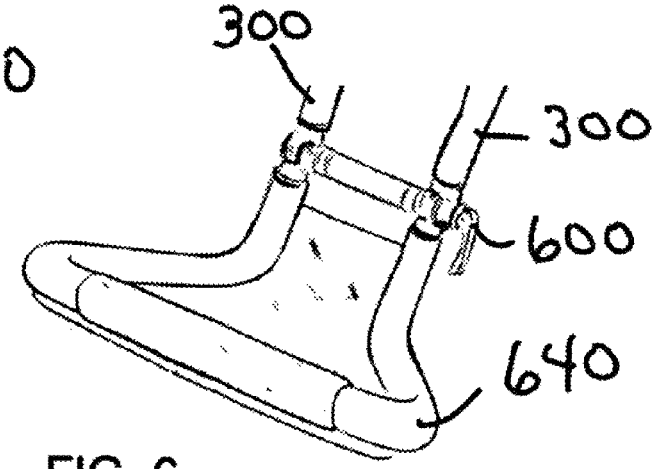
FIG. 6 is a perspective top view of an alternate exemplary footrest useable with a mount adapter according to the present invention.

Referring now primarily to FIG. 6, an alternate exemplary embodiment footrest 640 is shown where a pair of footrest legs 300 may have a common hinge 600, permitting the exemplary footrest 640 to have a deployed position, where the footrest 640 is extended away from a base 20, and a stowed position, where the footrest 640 is folded toward the base 20. The common hinge 600 may have a unitary locking mechanism, capable of holding the footrest 640 in either the deployed or stowed position, or various positions in between.

Figure 7:
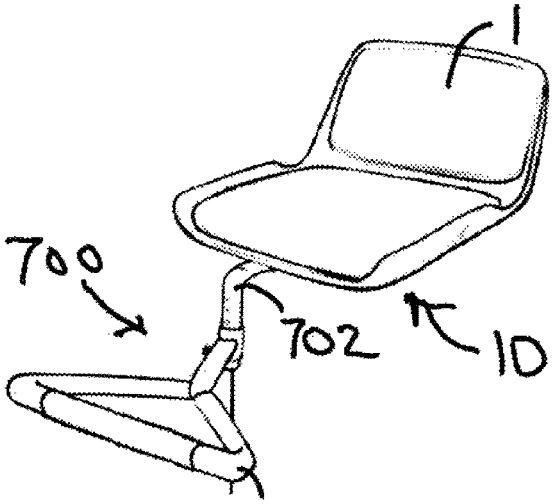
FIG. 7 is a perspective top view of an alternate exemplary seat, footrest, and anchor line feed tube useable with a mount adapter according to the present invention.
Figure 8:
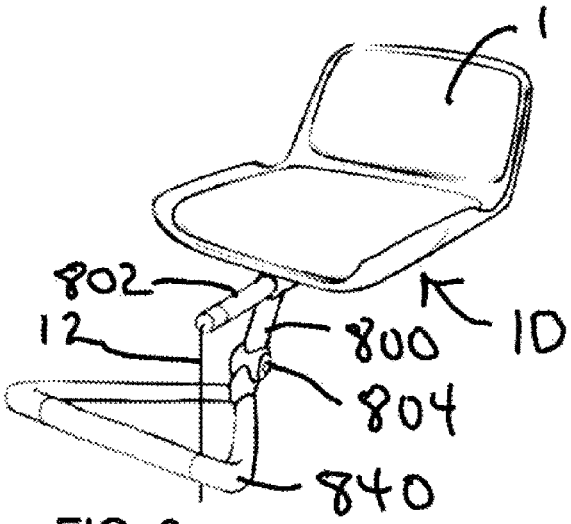
FIG. 8 is a perspective top view of an alternate exemplary seat, footrest, and anchor line feed tube useable with a mount adapter according to the present invention.
Figure 9:
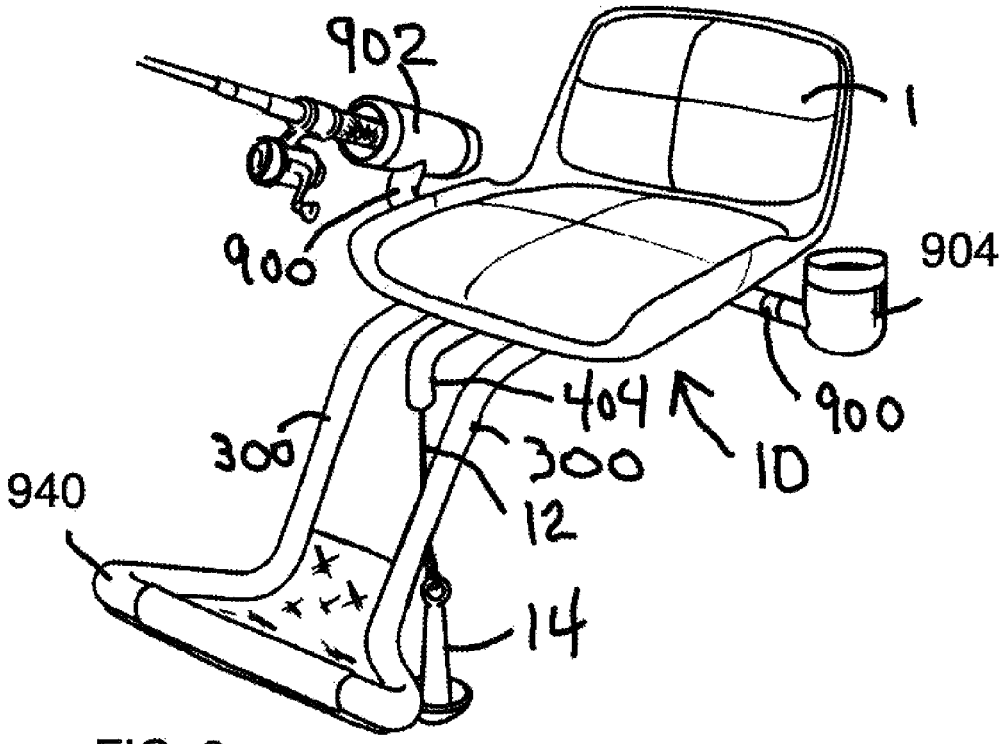
FIG. 9 is a perspective top view of an alternate exemplary seat and accessories configuration useable with a mount adapter according to the present invention.
Figure 10:
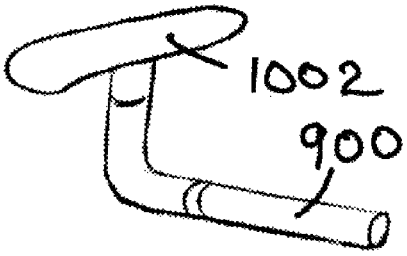
FIG. 10 is a perspective top view of an exemplary armrest accessory useable with a mount adapter according to the present invention.
Figure 11:
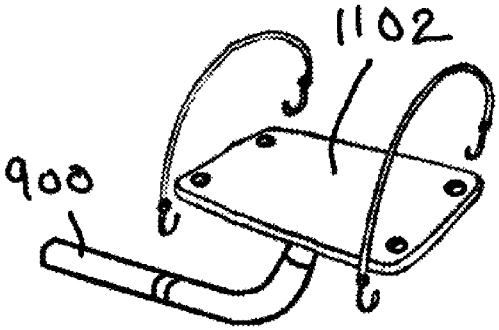
FIG. 11 is a perspective top view of an exemplary accessory tray useable with a mount adapter according to the present invention.
Figure 12:
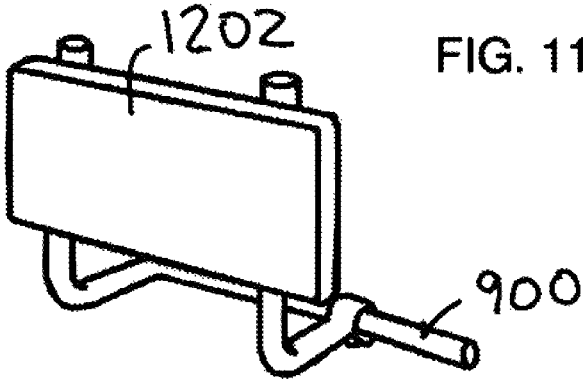
FIG. 12 is a perspective top view of an exemplary motor mount accessory useable with a mount adapter according to the present invention.

Referring now primarily to FIGS. 7 and 8, an alternate exemplary embodiment footrest 740 is shown where the footrest 740 is attached and supported by an anchor line guide 702. An additional alternate exemplary embodiment footrest 840 is shown where the footrest 840 is attached to the underside of the anchor line guide 802, and the anchor line may pass through the footrest 840. In the exemplary embodiment, footrest leg 800 is shown to possibly have a hinge 804. Having a hinge 804, exemplary footrest 840 may have a deployed position, where the footrest 840 is extended away from a base 20, and a stowed position, where the footrest 840 is folded toward the base 20. The hinge 804 may have a locking mechanism capable of holding the footrest 840 in either the deployed or stowed position, or various positions in between.

Referring now primarily to FIGS. 9 through 12, in addition to all of the prior figures, an alternate exemplary embodiment of gunwale mount adapter 10 is shown supporting a variety of boating and fishing accessories. An exemplary seat 1 is mounted on gunwale mount adapter 10. Exemplary footrest 940, supported by footrest legs 300, and exemplary anchor line guide 403 may extend from under seat 1. An anchor line 12 may descend from the anchor line guide 404, to control the anchor 14. An exemplary accessory bracket 900 may attached to one side of the gunwale mount adapter 10, and support a fishing pole accessory 902, and an additional accessory bracket 900 may be attached to the other side of the gunwale mount adapter 10 and support a cupholder accessory 904. Other accessory brackets 900 may be adapted with other accessories and be attached to an accessory receiver 202 on the gunwale mount adapter 10. Exemplary accessories include armrest accessory 1002, tray accessory 1102, and motor mount accessory 1202

Figure 13:
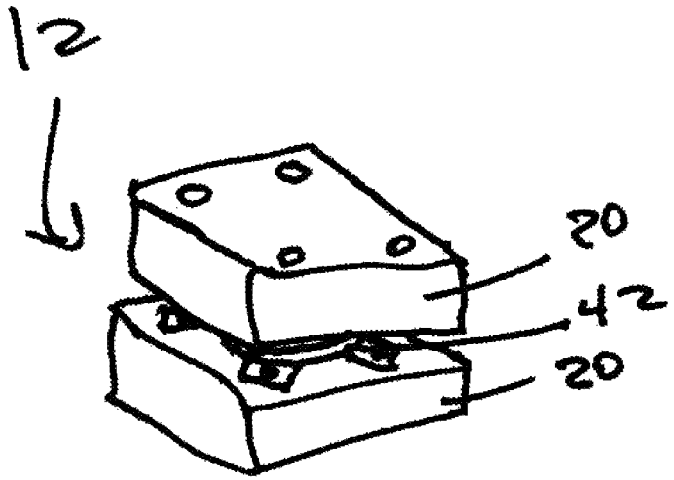
FIG. 13 is a perspective view of an exemplary stacked adapter according to the present invention.

Referring now primarily to FIG. 13, an alternate exemplary embodiment, a gunwale mount adapter 12 may comprise a pair of bases 20, with a swivel 42 intermediate the two bases 20.

Figure 14:
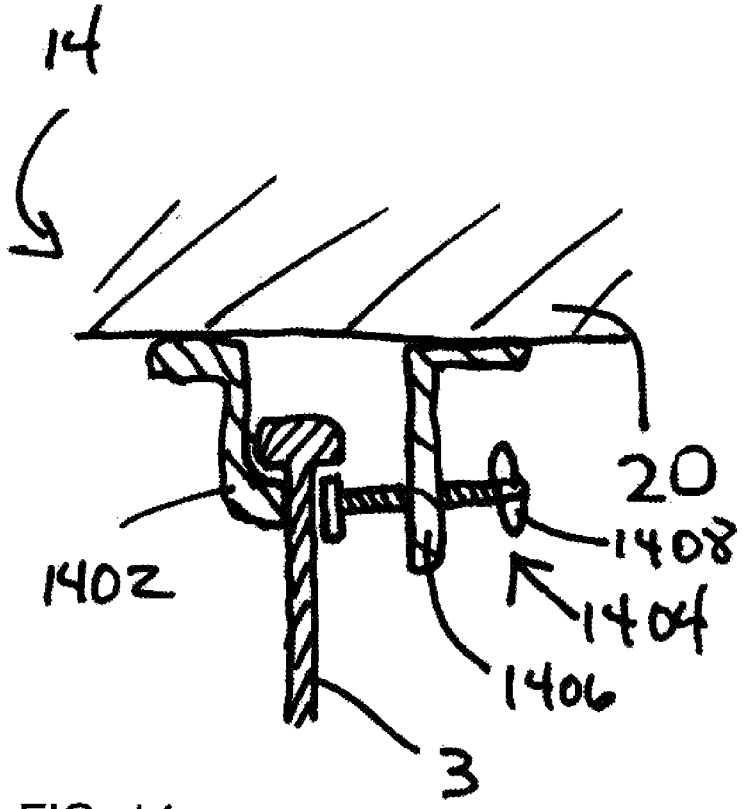
FIG. 14 is a side view of the bottom surface of an alternate exemplary mount adapter according to the present invention.

Referring now primarily to FIG. 14, an alternate exemplary embodiment of a gunwale mount adapter 14 may comprise a base 20 with a clamp mount 1400 on one face to securely interface with a rigid gunwale 3. The clamp mount 1400 may be structured to fit over a rigid gunwale 3, with a rigid brace 1402 on one side of the gunwale 3 and a clamp 1404 on the other side of the gunwale 3. The clamp 1404 may have a stationary frame 1406 and a moveable part 1408 where the moveable part 1408 may be moveable in a direction toward and away from the rigid brace 1402, with the rigid gunwale 3 intermediate. Tension by the clamp 1408 against the gunwale 3, would create tension between the gunwale 3 and the rigid brace 1402, creating a secure mount to a gunwale 3.

Figure 15:
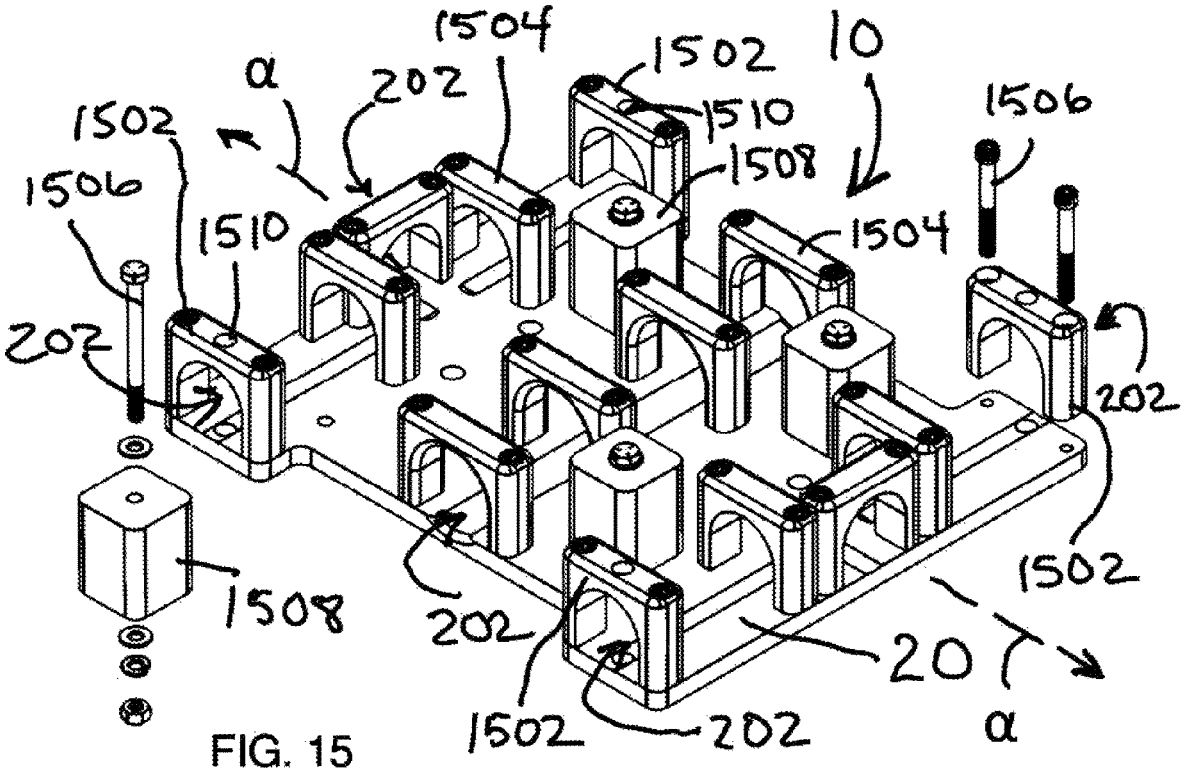
FIG. 15 is a perspective top view of an alternate exemplary mount adapter according to the present invention.
Figure 16:
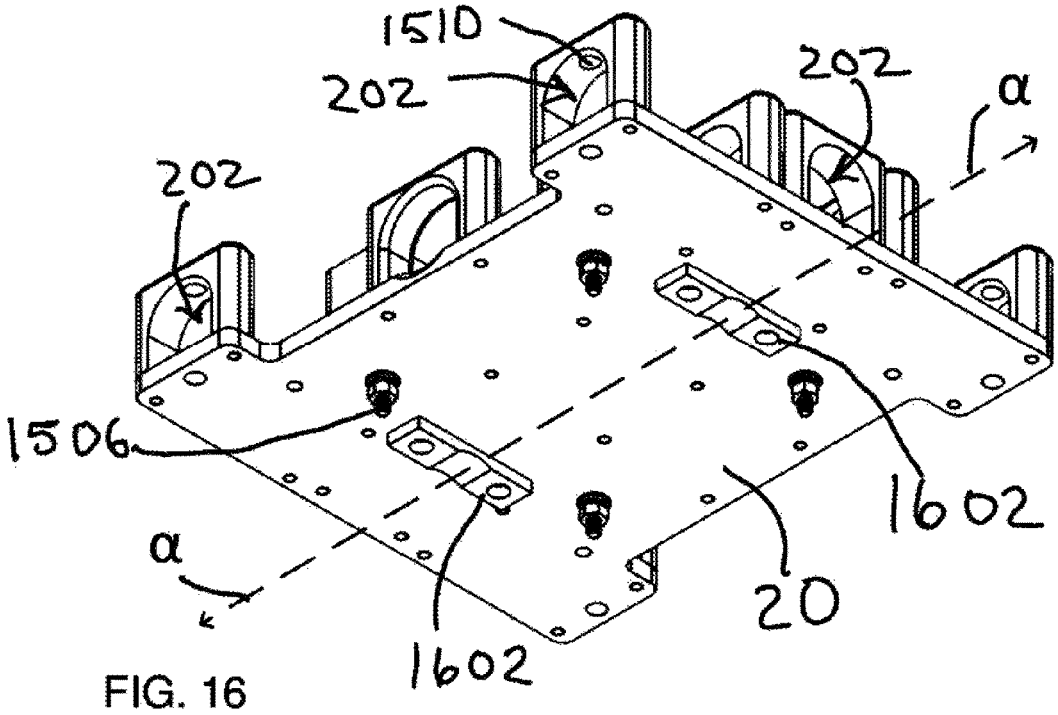
FIG. 16 is a perspective bottom view of the alternate exemplary mount adapter shown in FIG. 15.

Referring now primarily to FIGS. 15 and 16, and alternate exemplary embodiment of a modular mount adapter 10. The exemplary mount adapter 10 is structured on a base 20, configured to support the attachment of multiple securement brackets (1502, 1504) and spacers 1508. In the exemplary embodiment, both securement brackets (1502, 1504) and spacers 1508 may be removably secured to the base 20 with securement bolts 1506, which in the exemplary embodiment are paired with appropriate washers and a hex nut. Alternate forms of securement bolt 1506 may be understood by one of ordinary skill in the art of mechanical assembly and design, and the equivalence of a securement bolt 1506 is within the scope of this disclosure.

Securing securement brackets 1502 may have a hole 1510 for receiving a securement bolt 1506 therethrough. Securing securement bracket 1502 creates an accessory receiver 202, where an accessory, such as a footrest 300 or a variety of other boating and fishing accessories, may be secured to the mount adapter 10 with a securement bolt 1506 through hole 1510, secured to base 20. Standard securement bracket 1504 also supports an accessory receive 202, but is not configured to affirmatively secure the accessory, though some securement is obtained with leverage and friction.

Spacers 1508 provides a removable platform for the attachment of a seat 1. In an exemplary embodiment, a seat 1 may be secured to the mount adapter 10 with an intermediate swivel 42. In an exemplary embodiment, swivel 42 may secure to the spacers 1508 with securement bolts 1506.

In an exemplary embodiment, a mount block 1602 may provide a securement location for a frame 2 tube. Mount brackets 200 may be employed to secure a frame 2 to a base 20 at a mount block 1602. The combination of mount block 1602 and one or more mount brackets 200 may be referred to as a base securement. In the exemplary embodiment, it is shown that the base 20 may have an alignment line a that depicts how the base 20 may align on the perimeter of a boat along a frame 2 or a gunwale 3. The alignment line a can be understood to delineate an outward portion 1520 of the base 20 from an inward portion 1522 of the base 20. The outward portion 1520 would extend outwardly from a boat when the base 20 is attached to a frame 2 or a gunwale 3.

Referring now primarily to FIGS. 2, 3, and 4, It is understood that a frame 2 may provide a position for a seat 1 to be positioned high at the side of a boat, with the frame 2 or a gunwale 3 defining the perimeter of a boat. A seat 1 positioned on a frame 2 or a gunwale 3 may be seen to both extend into the interior of a boat and extend outwardly from a boat, over the exterior of a boat. The frame 2, and therefore the boat, may have a perimeter p that defines the outer perimeter of a boat. One horizontal direction from the perimeter p is understood to be outward from the frame 2, gunwale 3, or boat, and the other horizontal direction from the perimeter p is understood to be inward. At any point outward and inward may be directly opposite, but since a boat is a contained area, as is a frame 2, or the gunwale 3, the frame 2 and gunwale 3 encircle the boat perimeter p, defining a contained area that is "inward", and excluding an area that is "outward".

In an exemplary embodiment, the base 20 is securable to the edge of a boat, and the swivel 42 permits a seat 1 to rotate between a position facing inward and a position facing outward. In an exemplary embodiment, legs 300 may be in a position where they extend outwardly from a mount adapter 10. In an exemplary embodiment, an anchor guide 404 may be in a position where they extend outwardly from a mount adapter 10. In an exemplary embodiment, a variety of boating and fishing accessories may be securable to the mount adapter 10 at an accessory receiver 202, and thereby rotate with a seat 1 between a position facing inward and a position facing outward.

The foregoing disclosure and description of the invention are illustrative and explanatory thereof. The examples contained in this specification are merely possible implementations of the current device, and alternatives to the particular features and elements may be changed without departing from the spirit of the invention. The present invention should only be limited by the following claims and their legal equivalents, since the provided exemplary embodiments are only examples of how the invention may be employed and are not exhaustive.

I claim:

1. A mount adapter, comprising:
a base attachable to a tubular frame for an inflatable boat, the frame having a perimeter defining the boundary between an inward space and an outward space;
the base having an alignment line;
a base securement capable of securing a side of the base to the perimeter of the frame with the alignment line positioned parallel to the perimeter creating an outward portion of the base occupying a portion of the outward space and an inward portion of the base occupying a portion of the inward space;
at least one securement bracket attachable to the base on a side opposite the base securement, the at least one securement bracket having an accessory receiver; and
at least one spacer attachable to the base on a side opposite the base securement capable of supporting attachment of a seat.

2. The mount adapter of claim 1, further comprising:
a swivel attachable to the at least one spacer.

3. The mount adapter of claim 2, further comprising:
a seat attachable to the swivel, the seat having a first position facing the outward space and second position facing the inward space.

4. The mount adapter of claim 3, further comprising:
a footrest having a leg, the footrest attachable to the base by insertion of a portion of the leg into the accessory receiver.

5. The mount adapter of claim 4, further comprising:
the leg being securable to the accessory receiver.

6. The mount adapter of claim 5, further comprising:
the leg being securable to the accessory receiver.

7. The mount adapter of claim 1, further comprising:
a footrest having a leg, the footrest attachable to the base by insertion of a portion of the leg into the accessory receiver.

8. The mount adapter of claim 1, further comprising:
the accessory receiver oriented along the base alignment line.

9. The mount adapter of claim 1, further comprising:
the attachment of the at least one securement bracket to the base forming an accessory receiver.

10. The mount adapter of claim 1, further comprising:
an anchor guide extending from the outward portion of the base.

11. A mount adapter, comprising:
a base attachable to a tubular frame for an inflatable boat, the frame having a perimeter defining the boundary between an inward space and an outward space;
the base having an alignment line;
a base securement capable of securing a side of the base to the perimeter of the frame with the alignment line positioned parallel to the perimeter creating an outward portion of the base occupying a portion of the outward space and an inward portion of the base occupying a portion of the inward space;
at least one securement bracket attachable to the base on a side opposite the base securement, the at least one securement bracket having an accessory receiver; and
the base supporting attachment of a seat.

12. The mount adapter of claim 11, further comprising:
at least one spacer attachable to the base on a side opposite the base securement capable of supporting attachment of the seat.

13. The mount adapter of claim 12, further comprising:
a swivel attachable to the at least one spacer.

14. The mount adapter of claim 13, further comprising:
a seat attachable to the swivel, the seat having a first position facing the outward space and second position facing the inward space.

15. The mount adapter of claim 14, further comprising:
a footrest having a leg, the footrest attachable to the base by insertion of a portion of the leg into the accessory receiver.

16. The mount adapter of claim 15, further comprising:
the leg being securable to the accessory receiver.

17. The mount adapter of claim 11, further comprising:
a footrest having a leg, the footrest attachable to the base by insertion of a portion of the leg into the accessory receiver.

18. The mount adapter of claim 11, further comprising:
the accessory receiver oriented along the base alignment line.

19. A mount adapter, comprising:

a base having an alignment line and attachable with the alignment line aligned with a perimeter of a boat, the perimeter defining the boundary between an inward space of the boat and an outward space of the boat, the base thereby having an outward portion for extension into the outward space;

the base capable of supporting attachment of the seat, a seat having a first position facing the outward space and second position facing the inward space; and a footrest having a leg, the leg attachable to the outward portion of the base.

20. The mount adapter of claim 19, further comprising:

an anchor guide extending from the outward portion of the base.

* * * * *